United States Patent [19]

Renfro

[11] Patent Number: 5,033,139

[45] Date of Patent: Jul. 23, 1991

[54] DEVICE TO SECURE TOP SHEET OF BEDDING

[76] Inventor: Robert G. Renfro, 6426 E. Printer Udell, Tucson, Ariz. 85710

[21] Appl. No.: 546,721

[22] Filed: Jul. 2, 1990

[51] Int. Cl.[5] ..... A47G 9/04

[52] U.S. Cl. ..... 5/508; 24/72.5; 5/496; 29/428; 29/448

[58] Field of Search ..... 5/496, 498, 508; 24/72.5; 29/428, 448

[56] References Cited

U.S. PATENT DOCUMENTS

| | | | |
|---|---|---|---|
| 2,507,091 | 5/1950 | Carlson | 5/496 |
| 2,653,363 | 9/1953 | Lievsay, Jr. | 24/72.5 |
| 3,066,323 | 12/1962 | Kintner . | |
| 4,040,133 | 8/1977 | Gilreath . | |
| 4,144,602 | 3/1979 | Fernandes . | |
| 4,241,466 | 12/1980 | Mendyk . | |
| 4,276,667 | 7/1981 | Osbourne | 5/498 |
| 4,301,561 | 11/1981 | McLeod | 5/496 |
| 4,488,323 | 12/1984 | Colburn | 5/496 |

*Primary Examiner*—Alexander Grosz
*Attorney, Agent, or Firm*—J. Michael McClanahan

[57] ABSTRACT

A device to secure the top sheet of bedding from being accidently pulsed out at the foot of the bed is disclosed wherein an elongated piece of plastic material is provided for placement between the mattress and the box springs of a bed wherein the end of the tucked-in top sheet of the bed is in contact with one side of the elongated piece of material, and the other side of the elongated piece is in contact with the box springs. The top sheet securing device is constructed of materials which have a high coefficient of static friction such that the weight of the mattress pressing down upon the tucked-in top sheet is sufficient to provide compression of the plastic material between the top sheet and lower box springs that the top sheet is held in position against the unintentional or accidental pulling out. the top sheet securing device may be alternately made of a thin sheet of vinyl plastic or a thickness of open or closed cell low density polyurethane foam, or a combination of vinyl plastic and polyurethane foam.

11 Claims, 1 Drawing Sheet

DEVICE TO SECURE TOP SHEET OF BEDDING

BACKGROUND OF THE INVENTION

1. Field of the Invention

The field of the invention is devices for holding bedding in position and more particularly for securing the top sheet against accidently being pulled out from its position tucked in between the mattress and box springs.

2. Description of the Related Art

There has been quite a bit of activity over the last number of years of devices in bedding adapted to prevent both the bottom sheet and top sheet from being pulled out of their tucked in position between the top mattress and lower box springs. With the advent of the bottom fitted sheet, commonly called a contour sheet, which appears to be utilized in perhaps the great majority of beds in personal residences, the problem of the bottom sheet being accidently pulled out from between the mattress and box springs has been alleviated substantially. However, it appears that this solution to bottom sheet problems has not been extended appreciably to beds in hotels and motels. Nevertheless, the problem of the top sheet pulling out, which usually is not fitted at its lower end, has not been satisfactorily solved even though there have been many devices patented attempting to remedy this problem.

For example, Kintner in U.S. Pat. No. 3,066,323 proposes locating small patches of hooking material at strategic places upon one or both of the sheets and the mattress in order to hold the sheets in place. Variations of Kintner's device is shown in subsequent patents to Gilreath (U.S. Pat. No. 4,040,133), Fernandes (U.S. Pat. No. 4,144,602), Mendyk (U.S. Pat. No. 4,241,466), and Colburn (U.S. Pat. No. 4,488,323).

Interestingly, McLeod in U.S. Pat. No. 4,301,561 utilizes the same type of attachment device but attaches the sheets to another piece of material which resides between the mattress and the box springs and comes up the perimeter sides of the mattress to its point of engagement of the sheets.

In a mechanical device for holding the bed clothes in position, Osbourne in U.S. Pat. No. 4,276,667 details a "L" shaped device wherein the long leg portion of the device is stationed between the mattress and box springs and the short arm of the "L" contains a rubber block which forcibly grips the bed clothes from the outside at a position half way up the thickness of the mattress.

While the prior art devices and techniques known to the inventor appear to adequately perform their function, yet, these devices require considerable modification to the sheets or require holding devices which reside on the outside of the bed and therefore are very obvious and which may present a problem to the user. In addition, the attachment type devices shown in the above patents may entail substantial manufacturing costs, especially in regard to the labor involved in integrating them to the sheets and where applicable, to the mattress.

In any event, it is readily apparent that the devices of the above patents or any other devices are not in wide spread use as this inventor has not encountered any of them.

Therefore it is apparent that there is an obvious need for a device which is simple to use, which is easily constructed, and which may be reasonably priced. It is to this need for means to secure the bottom or lower end of bedding sheets, and particularly the top sheet, in their relationship to mattresses and box springs, that the subject invention is directed.

SUMMARY OF THE INVENTION

The embodiment of the invention described consists of a top sheet securing device adapted to be placed at the foot of the bed between the bottom box springs and the top mattress in such a way that it resides next to and secures the top sheet from being accidently pulled out such as by a person sleeping in the bed.

In construction, the subject top sheet securing device comprises an elongated sheet or piece of material which lays across the full width of the bed, or substantially so, and has a width of four (4) to eight (8) inches. In thickness it may vary from 1/32 of an inch to ½ inch, but if of the greater thickness, it is material easily compressible such that it is not noticeable by a person lying on the bed mattress.

The subject invention has two (2) flat opposing surfaces, i.e., a top and a bottom surface, and is flexible although varying degrees of flexibility would be easily tolerated, so long as the invention were not as "stiff as a board". The important factor is that its presence not be noticeable by the user.

In use, the subject invention is engaged and pressed upon by the top sheet which, after being tucked in under the foot of the mattress, completely encompasses the top flat surface of the securing device. The bottom flat surface of the securing device then resides entirely upon the box springs. The function of the device is to place sufficient "grabbing" or "holding" resistance, i.e., static frictional resistance, to the end of the top sheet such that sufficient restraint is presented to the top sheet from being pulled out accidently from its position between the mattress and the box springs by a sleeper or a person using the bed. The invention is not intended to resist all efforts to pull the top sheet out from between the mattress and box springs, but to hold on to the top sheet sufficiently that it will not pull out except when it is intended to do so.

In the preferred embodiment, two (2) materials have proven equally adaptable to the assigned task of frictionally holding the top sheet in place. The first has been a thin (1/16 inch) sheet of soft vinyl plastic and the second has been a sheet of low-density polyurethane foam, either open or closed cell, having a thickness of anywhere from between ⅛ inch and ½ inch. In the case of low-density foam, compression of the material is achieved by the mere weight of the mattress and the person on the bed never detects that the device has been placed between the mattress and the box springs. With either of the materials chosen, the frictional resistance to the top sheet from being pulled out has been more than adequate.

In addition, the device may be utilized not only to secure the top sheet in its tucked-in position between the mattress and the box springs at the end of the bed, but by judicious placement of additional embodiments of the invention, to also secure the bottom sheet in position on the mattress. The same theory of operation is used for the bottom sheet, that sufficient holding or grabbing power is provided between the mattress and the bottom sheet such that the bottom sheet will not slide past the subject invention to allow itself to be unintentionally pulled out.

Accordingly, it is an object of the subject invention to provide a means whereby the top sheet upon a bed may be sufficiently secured in a position tucked-in between the mattress and the box springs that it will not unintentionally come out.

It is another object of the subject invention to provide a concealed and undetectable securing device by which the top sheet of a bed will not come out from its position tucked-in between the mattress and the box springs.

It is still a further object of the subject invention to provide an easily constructed economical device by which the top sheet, and if desired, bottom sheet, may be secured in position tucked-in between the mattress and the box springs of a bed against unintentional pulling out.

Other objects of the invention will in part be obvious and will in part appear hereinafter. The invention accordingly comprises the apparatus possessing the construction, combination of elements, and arrangement of parts which are exemplified in the following detailed disclosure and the scope of the application which will be indicated in the claims.

BRIEF DESCRIPTION OF THE DRAWINGS

For further understanding of the features and objects of the subject invention, reference should be had to the following detailed description taken in connection with the accompanying drawings wherein.

In various views, like index numbers refer to like elements.

DETAILED DESCRIPTION OF THE PREFERRED EMBODIMENT

Figures 1, 2, 3, 4, 5, 6, 7:
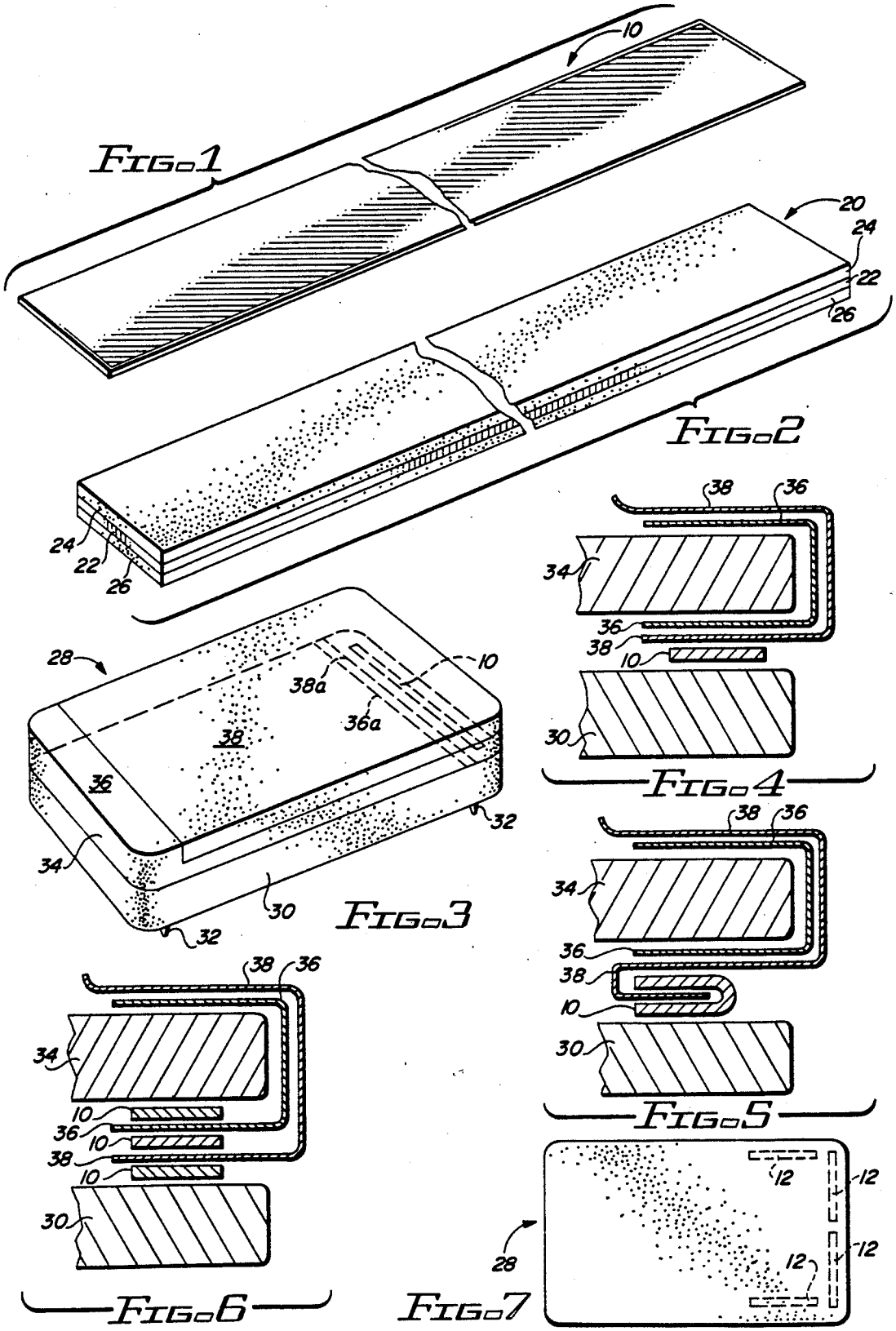
FIG. 1 is a perspective view of the subject invention.
FIG. 2 is a perspective view of an alternate embodiment of the subject invention.
FIG. 3 is a perspective view of a bed utilizing the subject invention.
FIG. 4 is a partial cross-sectional view of the foot of a bed utilizing the preferred embodiment of the invention.
FIG. 5 is a partial cross-sectional view of the foot of a bed utilizing the invention in an alternate embodiment setting.
FIG. 6 is a partial cross-sectional view of the foot of a bed utilizing a plurality of the invention in an alternate embodiment setting.
FIG. 7 is a top view of a bed showing alternate configurations and placement of the invention.

Referring now to FIG. 1, a perspective view is shown of the subject top sheet securing device 10 for use in holding the lower end of the top sheet of bedding in a secured position between a mattress and box springs. Top sheet securing device 10 is, in its preferred embodiment, made of soft pliable plastic material, such as vinyl plastic, flexible, having oppositely situated flat surfaces, and generally four (4) to eight (8) inches wide. It has a length which is preferably equal to the width of a bed, or it may be the width of a bed less a short distance, i.e., six (6) to twelve (12) inches. In the preferred embodiment the plastic member has a thickness in the order of 1/32 of an inch to an ⅛ inch, nominally 1/16 inch.

In a second embodiment which is also a preferred embodiment, top sheet securing device 10 has been constructed of ½ inch thick polyurethane foam plastic of the same width and length as that for the thin vinyl plastic. In such an embodiment, the foam is very easily compressible and presents no impediment discernible from the top of the mattress.

As will be more fully explained infra, top sheet securing device 10 is designed to be placed between the mattress of a bed and the underlying box springs near or at the foot of the bed. In its preferred position, top sheet securing device 10 resides immediately atop the box springs such that one flat side of the invention engages the box springs and the other flat side engages the top sheet. The choice of material utilized for the top sheet securing device is such that it have a relatively high coefficient of static friction with cloth material such as utilized in sheets and the outside cloth cover of box springs so that with the weight of the mattress pushing down upon the top sheet as tucked-in under the mattress (and resting upon the top flat surface of the invention), there will be sufficient resisting force created, in the form of static friction, to prevent the top sheet from easily sliding past the top flat surface of the invention, and the bottom surface of the invention from sliding upon the top material surface of the box springs.

It is readily apparent that the inventor's choice of vinyl plastic and polyurethane foam plastic are merely two examples of materials which may be utilized as the invention. There are many other materials which could also be utilized as the invention which have the required sufficiently high coefficient of static friction, are flexible, and are thin, and thus able to achieve the desired result. The inventor's choice of vinyl plastic and polyurethane foam plastic were two materials which fit the requirements and which were relatively inexpensive and widely available.

Thus, prior to the placement of the invention between the mattress and the box springs, the end of the top sheet tucked-in between the mattress and the box springs could be easily pulled out by a person's movements while sleeping on the bed. With the friction created by the subject invention, sufficient resistance to the top sheet sliding by the box springs material surface has been created such that the top sheet may be only be pulled out by the exertion of intentional considerable force, much more than that which would be exerted by a sleeping person.

The inventor has experimented with various configurations having the qualities desired and has come up with an alternate embodiment as shown in FIG. 2 which works as well as the preferred embodiment of FIG. 1, but presents the invention with an increased thickness and cost to manufacture. One obvious advantage is that it is more rigid and thus easier to handle. Referring specifically to FIG. 2, alternate top sheet securing device 20 is shown made up of sandwiched layers of materials. The central layer 22 comprises material such as vinyl plastic in a thickness of 1/16 inch or so followed with two outside layers, top layer 24 and bottom layer 26. These layers are identical in composition and in thickness, comprising layers of polyurethane foam. With polyurethane foam layers, the top and bottom layers each have a thickness in the range of 1/16 to ¼ inch. In addition, it is entirely possible to utilize the hook-type VELCRO material for each of these layers, in which case the thickness then generally an ⅛ of an inch or so. In both embodiments, the top layer 24 and the bottom layer 26 are each bonded to opposite sides of central layer 22 by means of an appropriate adhesive. Like the preferred embodiment of FIG. 1, the alternate top sheet securing device is four (4) to eight (8) inches wide and as long as a bed is wide. It is also characterized by its opposite flat surfaces and is flexible.

Referring now to FIG. 3, a perspective view of a typical bed employing the invention is detailed. Firstly, the lower most supporting portion of the bed is shown, namely rectangularly shaped box springs 30 resting upon its legs 32 of which there is at least four (4). Immediately above box springs 30 is rectangularly shaped mattress 34. The mattress is of the same size as the box springs and generally the thicknesses of each are also about equal although the box springs may be slightly thicker. As is well known, conventional beds can run from six (6) to eight (8) feet long and from three (3) to seven (7) feet wide. Covering mattress 34 is bottom sheet 36 which, in most residential applications will be fitted or contour sheet, i.e., the corners are sewed together such as to completely encompass in a holding relationship the top and peripheral sides of the mattress. Lastly, covering the majority portion of the top surface of the mattress from the foot up is top sheet 38 which, in most all cases is not fitted. This means that top sheet 38 is usually a rectangular piece of cloth material which requires that it be tucked-in at the foot of the bed, i.e., that portion of the bed to the right in FIG. 3. The subject top sheet securing device 10 is shown in dotted form at the foot of the bed and under mattress 34. Also shown in FIG. 3 is bottom end **36*a* of bottom sheet 36 and bottom end 38*a* of top sheet 38. Given that the top and bottom sheet fold over and wrap around the foot of the bed shown in FIG. 3, it can be appreciated that both of these sheets will pass completely over the subject top sheet securing device 10** (although only the top sheet will be touching it).

Thus, in the position shown in FIG. 3, the top sheet securing device 10 is in place ready to resist pulling of the top sheet 38 out from its tucked-in position between mattress 34 and box springs 30.

Different variations of configurations utilizing the subject invention is shown in FIGS. 4–6 wherein the relationship of the invention to the top and bottom sheets, and to the mattress and box springs is shown in partial cross-sectional views taken at the foot of bed 28. For example, in FIG. 4, mattress 34 is shown overlying box springs 30 with the top and the end of the mattress encompassed by bottom sheet 36 and by top sheet 38. For best and most effective operation of the invention, top sheet 38 completely laps over the full width of top sheet securing device 10 which itself resides upon the top surface of box springs 30.

FIG. 5 shows an alternate embodiment of the subject invention wherein the subject inventive top sheet securing device 10 has been folded along its length to form a trough and top sheet 38 has similarly been folded around one side of the trough to the point where its bottom end enters the trough formed by the subject invention. In this configuration, the very end of top sheet 38 now is being frictionally held on opposite sides by the invention 10 and then along an additional strip where top sheet 38 bends back again to make frictional contact with the top of the trough. In this configuration of the invention, it is suggested that the width of the top sheet securing device be generally in the order of double that of the invention shown in the embodiment of FIG. 4.

In FIG. 6 an alternate embodiment is shown utilizing three (3) embodiments of the subject inventions wherein the securing device 10 has been placed between every possible material surface presented between the sheets tucked-in between the box springs and mattress. Here, a fitted bottom sheet has not been utilized, but instead a flat sheet which must be tucked-in. In this case, the first embodiment of the subject invention is placed between the top mattress 34 and one side of the bottom sheet 36, as well as in between the opposite side of the bottom sheet 36 and one side of the top sheet 38, and thirdly, between the other side of the top sheet 38 and the box springs 30. In the configuration shown in FIG. 6, both the top and the bottom sheets will vigorously resist being accidently pulled out from between the mattress and the box springs by the sleeping person. The embodiment shown in FIG. 6 may be very useful in hotels which customarily do not use fitted bottom sheets but use both a top and bottom sheet interchangeably, tucking the bottom sheet in around all of the peripheral rim of the mattress, and tucking the top sheet in only at the bottom of the mattress.

Lastly, referring to FIG. 7, an alternate embodiment of the subject invention is shown wherein the preferred embodiment of the device running across the foot of the bed has been replaced by two (2) top sheet securing devices 12 which have been altered by shortening them. Further, the altered top sheet securing device 12 is additionally placed on opposite sides of the length of the bed between the mattress and the box springs in the configuration generally shown by FIG. 4. In the configuration shown in FIG. 7, additional protection is provided to the top sheet from being pulled from out from under the mattress along the sides as well as the foot of the bed.

It is realized that the configuration shown in FIG. 7 suggests utilization with bottom sheet placement of the invention along the head and the remaining portions of the bed not receiving the invention as shown in FIG. 7. By this arrangement, the bottom sheet is secured all around.

While a preferred embodiment of the invention, together with alternate embodiments, has been shown and described, it is appreciated that other such embodiments of the invention are possible and that there is no intent to limit the invention by such disclosure, but rather that it is intended to cover all modifications and alternates embodiments falling within the spirit and the scope of the invention as defined in the appended claims.

I claim:

1. In a bed having a head and a foot, and a width, the bed consisting of a box springs, a mattress overlying the box springs, a bottom sheet encompassing the mattress, and a top sheet substantially encompassing the bottom sheet, both the bottom and top sheets tucked in between the mattress and box springs at the foot of the bed, a top sheet securing device to restrain the top sheet from being accidently pulled out from between the mattress and box springs at the foot of the bed, the device comprising:

an elongated piece of compressible sheet polyurethane foam material adapted to be placed between the mattress and the box springs of the bed and engaging the top sheet, said material having a high coefficient of static friction when being pressed down upon by the mattress to engage the top sheet and the box springs.

2. The top sheet securing device as defined in claim 1 wherein said elongated piece of material is rectangular in shape, has two flat sides, of thin material construction, and flexible.

3. The top sheet securing device as defined in claim 2 wherein said elongated device is as long as the bed is wide.

4. The top sheet securing device as defined in claim 1 wherein said material comprises open cell low density sheet polyurethane foam.

5. The top sheet securing device as defined in claim 1 wherein said material comprises closed cell low density sheet polyurethane foam.

6. The top sheet securing device as defined in claim 1 wherein said device comprises a layered combination of sheet vinyl plastic and polyurethane foam.

7. The top sheet securing device as defined in claim 6 wherein said device comprises a layer of thin sheet vinyl plastic having two sides, and two layers of open cell low density sheet polyurethane foam, one of each of said layers of polyurethane foam attached to each side of said vinyl plastic.

8. In combination, a bed and a top sheet securing device, the combination comprising:

a bed having a head and a foot, and a width, the bed comprising a box springs, a mattress overlying said box springs, a bottom sheet encompassing said mattress, and a top sheet substantially encompassing said bottom sheet, both said bottom and top sheets tucked in between said mattress and said box springs at the foot of said bed, and a top sheet securing device situated between said mattress and said box springs and engaging to secure said top sheet and said box springs said securing device comprising compressible sheet polyurethane foam whereby said top sheet is restrained from being accidently pulled out from between said mattress and said box springs.

9. The combination as defined in claim 8 wherein said polyurethane foam comprises an elongated piece of material having a high coefficient of static friction when engaged by said top sheet and said box springs, said elongated piece of material being rectangular in shape, having two flat sides, of thin material construction, and flexible.

10. In a bed having a head and a foot, and a width, the bed consisting of a box springs, a mattress overlying the box springs, a bottom sheet encompassing the mattress, and a top sheet substantially encompassing the bottom sheet, both the bottom and top sheets tucked in between the mattress and box springs at the foot of the bed, a method of securing the top sheet of the bed in a tucked in position between the mattress and the box springs of the bed, the method comprising the steps of:

placing a first securing device of high coefficient of static friction upon said box springs and underneath said mattress;

placing said top sheet upon said first securing device;

placing a second securing device between said top sheet and said bottom sheet; and allowing said mattress to rest upon said top sheet, both said securing devices, and said box springs whereby said top sheet is restrained from being accidently pulled out from between the mattress and box springs by the high friction between said top sheet, both said securing devices, and said box springs.

11. The method of securing the top sheet of a bed as defined in claim 10 further including the step of:

placing a third securing device between said bottom sheet and said mattress whereby said securing device is placed between the box springs and top sheet, top sheet and bottom sheet, and bottom sheet and mattress respectively.

* * * * *